US008500311B1

(12) United States Patent
Leslie

(10) Patent No.: US 8,500,311 B1
(45) Date of Patent: Aug. 6, 2013

(54) CONE MOUNTING, SUPPORT OR GASKET APPARATUS

(71) Applicant: Howe David Leslie, Atlanta, GA (US)

(72) Inventor: Howe David Leslie, Atlanta, GA (US)

(73) Assignee: Southpac Trust International Inc., Rarotonga (CK), Trustee of the LDH Trust ( * ) Notice: Subject to any disclaimer, the term of this patent is extended or adjusted under 35 U.S.C. 154(b) by 0 days.

(21) Appl. No.: 13/758,222

(22) Filed: Feb. 4, 2013

Related U.S. Application Data

(63) Continuation of application No. 13/718,013, filed on Dec. 18, 2012.

(51) Int. Cl.
*F21V 1/00* (2006.01)

(52) U.S. Cl.
USPC ..... 362/356; 362/355

(58) Field of Classification Search
USPC ..... 362/351, 353, 355, 356, 360, 361; 232/43
See application file for complete search history.

(56) References Cited

U.S. PATENT DOCUMENTS

| | | | | |
|---|---|---|---|---|
| 315,835 | A * | 4/1885 | Raymond | 232/43 |
| 2,437,226 | A * | 3/1948 | Fischer | 220/576 |
| 4,392,190 | A * | 7/1983 | Upton | 362/281 |
| 2009/0052194 | A1 * | 2/2009 | Jowid | 362/351 |

* cited by examiner

*Primary Examiner* — Laura Tso

(57) ABSTRACT

Certain embodiments of the disclosed technology may include apparatuses for providing a cone mounting, support or gasket apparatus. According to an example embodiment of the disclosed technology, a cone mounting, support or gasket apparatus is provided that is configured to attach to a cone, wherein the cone comprises a directrix and an outer surface. The cone mounting, support or gasket apparatus comprises a ring shaped structure defined by an inner surface comprising a conical wall, wherein the conical wall has a bottom and a top. The bottom of the conical wall has a greater diameter than the top of the conical wall, and the angle of the conical wall is similar to the angle of the cone outer surface. The ring shaped structure includes a ledge, wherein the ledge originates at the bottom of the conical wall and protrudes away from the conical wall. The cone attaches to the cone support apparatus whereby the directrix of the cone is disposed on the ledge of the ring shaped structure.

18 Claims, 6 Drawing Sheets

FIG 1A
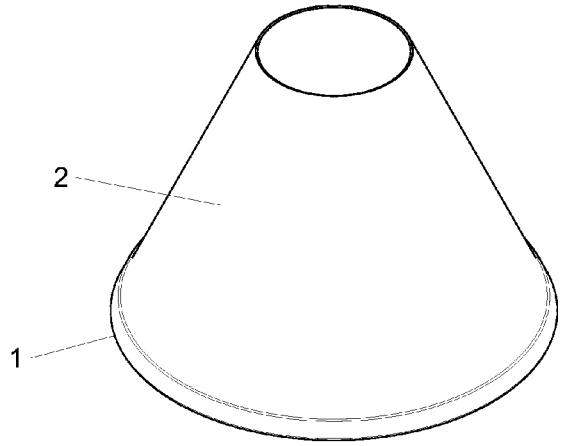
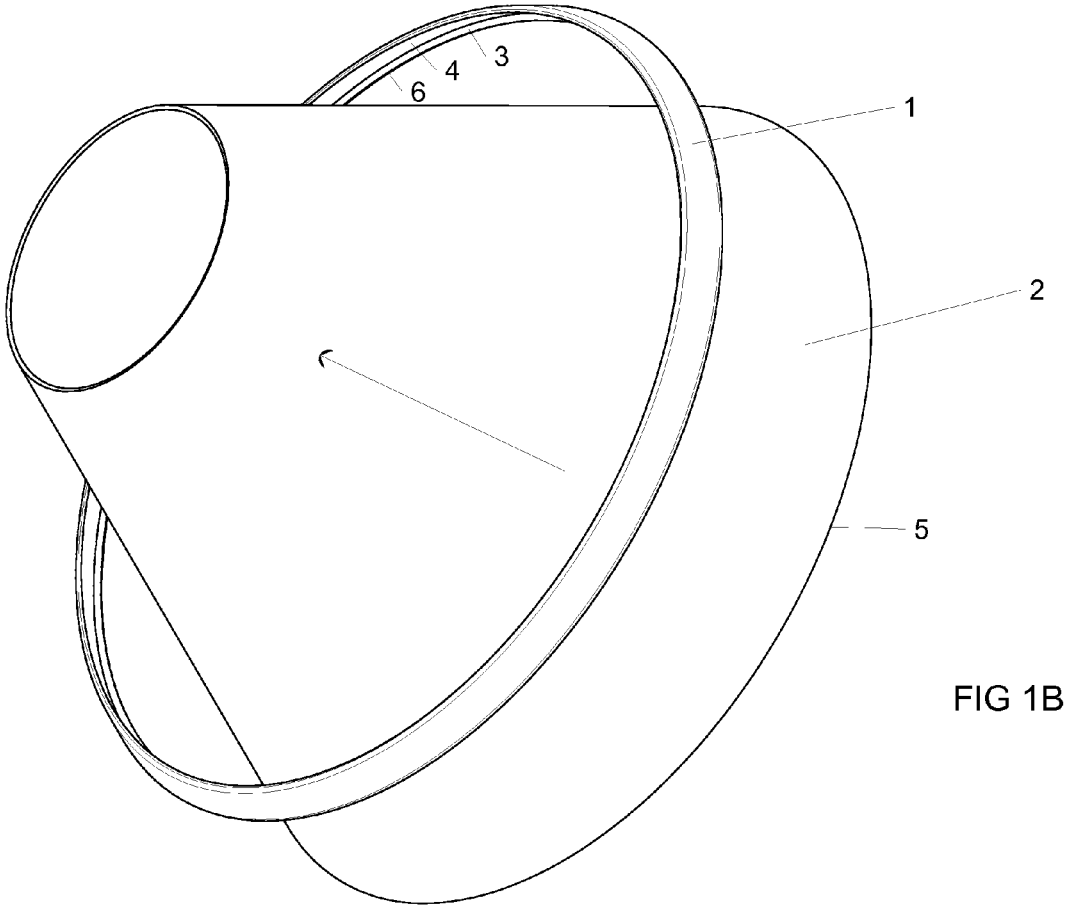
FIG 1B

FIG 6A
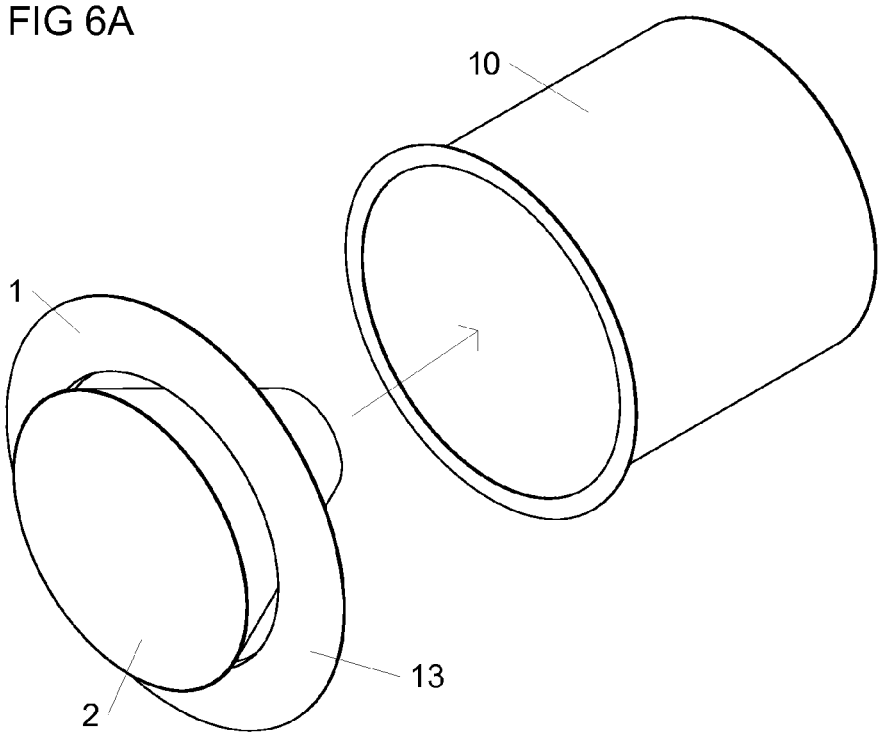
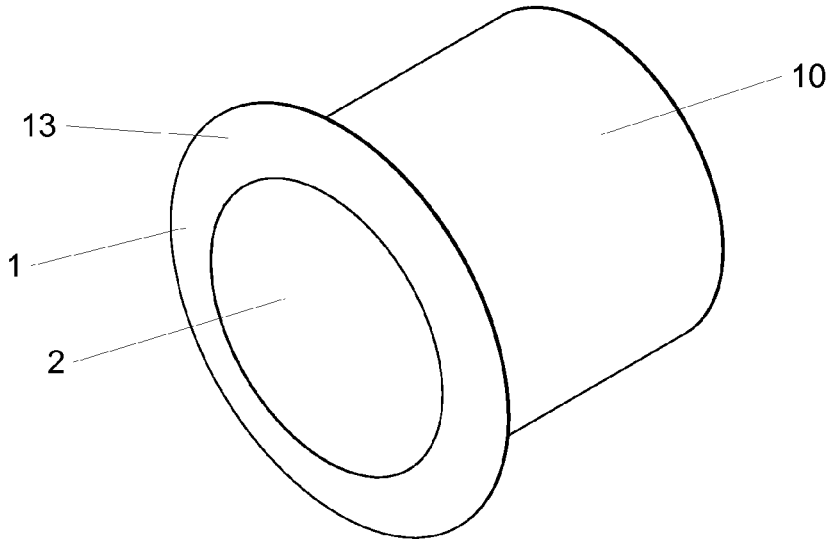
FIG 6B

CONE MOUNTING, SUPPORT OR GASKET APPARATUS

RELATED APPLICATIONS

This application is a continuation-in-part of U.S. non-provisional patent application Ser. No. 13/718,013, filed Dec. 18, 2012, and claims the benefit of the following United States provisional and non-provisional patent applications, the contents of which are incorporated herein by reference in their entirety, as if set forth in full: U.S. Provisional Patent Application No. 61/632,310 entitled "Light Reflector Cone" filed Jan. 23, 2012, and U.S. Provisional Patent Application No. 61/633,858 entitled "Light Reflector Cone" filed Feb. 21, 2012, and Provisional Patent Application No. 61/687,374 entitled "Light Reflector Cone" filed Apr. 25, 2012, and U.S. Provisional Patent Application No. 61/742,046 entitled "Light Reflector Cone" filed Aug. 2, 2012 and U.S. non-provisional patent application Ser. No. 13/718,013, filed Dec. 18, 2012

TECHNICAL FIELD

This invention generally relates to both light reflectors as described in previously listed patent applications, and mechanical fastening, support or gasket apparatuses or devices.

BACKGROUND

Example embodiments of light reflectors comprising cones made from one or more layers of optical films, which may be suitable for use in recessed light fixtures, are described in U.S. patent application Ser. No. 13/718,013, filed Dec. 18, 2012. Typical example embodiments may comprise one or more layers of optical films, which may be configured into a cone shape with a smaller top opening through which a light source may protrude through, and a larger bottom opening, which may serve as the optical aperture of the light reflector. According to example embodiments, the optical film cones may be configured from optical films under 200 um in thickness, and as such, the cones may be quite flexible, and may require a support structure for use in commercial light fixture applications, both as a means of mounting the reflector into a fixture, as well as securing the reflector in a suitably rigid configuration. It would indeed be beneficial if a support structure and/or mounting apparatus could be created with any or all of the following attributes:

A) Would be able to keep a reflector cone suitably rigid for use in a light fixture.

B) Would function as a mounting apparatus to attach a light reflector cone to a light fixture.

C) Would function as a mounting apparatus to retrofit a light reflector cone over top of an existing recessed downlight reflector.

D) Would function as a support device to give additional rigidity to a reflector cone thereby allowing the reflector cone to function as a standalone lamp retrofit.

E) Would attach to the reflector cone easily, and without the need for fasteners or adhesives.

F) Would allow the reflector cone to be removable from the support structure or mounting apparatus.

G) Would have a low manufacturing cost, and low labor cost.

Some or all of these advantageous may be realized in example embodiments that will be subsequently described. Additionally, example embodiments with advantageous properties which may apply to other applications and uses, such as a gasket apparatus, will also be described.

BRIEF SUMMARY

One example embodiment of the disclosed technology is directed to providing a cone mounting, support or gasket apparatus. According to an example embodiment of the disclosed technology, a cone mounting, support or gasket apparatus is provided that is configured to attach to a cone, wherein the cone comprises a directrix and an outer surface. The cone mounting, support or gasket apparatus comprises a ring shaped structure defined by an inner surface comprising a conical wall, wherein the conical wall has a bottom and a top. The bottom of the conical wall has a greater diameter than the top of the conical wall, and the angle of the conical wall is similar to the angle of the cone outer surface. The ring shaped structure includes a ledge, wherein the ledge originates at the bottom of the conical wall and protrudes away from the conical wall. The cone attaches to the cone support apparatus whereby the directrix of the cone is disposed on the ledge of the ring shaped structure.

Another example embodiment of the disclosed technology is directed to an apparatuses for providing a cone support and mounting apparatus configured to attach to a cone, wherein the cone comprises a directrix and an outer surface. The cone support and mounting apparatus comprises a ring shaped structure defined by an inner surface comprising a conical wall, wherein the conical wall has a bottom and a top. The bottom of the conical wall has a greater diameter than the top of the conical wall, and the angle of the conical wall is similar to the angle of the outer cone surface of the cone. The ring shaped structure includes a ledge, wherein the ledge originates at the bottom of the conical wall and protrudes towards away from the conical wall. The cone attaches to the cone support and mounting apparatus whereby the directrix of the cone is disposed on the ledge of the ring shaped structure, and the ring shaped structure is configured to attach to an external surface, including for example, a light fixture enclosure, a light fixture reflector, a light fixture reflector's trim ring, or a ceiling.

BRIEF DESCRIPTION OF THE FIGURES

FIG. 1A shows a perspective view of a cone mounted in an example embodiment of cone mounting, support or gasket apparatus.

FIG. 1B shows an exploded perspective view of a cone mounted in an example embodiment of cone mounting, support or gasket apparatus as shown in FIG. 1A.

FIG. 6A shows an exploded perspective view of an example embodiment of cone mount with reflector cone configured to attach to a light fixture enclosure.

FIG. 6B shows a perspective view of the example embodiment of cone mount with reflector cone configured to attach to a light fixture enclosure as shown if FIG. 6A.

DETAILED DESCRIPTION

Embodiments will be described more fully hereinafter with reference to the accompanying drawings, in which the embodiments may be shown. This invention may however, be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

Various methods, concepts, designs, and parts may be combined to produce desired operating specifications for cone mounting, support or gasket apparatuses. The terminology "cone mounting, support or gasket apparatuses" may be sometimes herein be referred to as "cone mount". Example embodiments and will now be described with reference to the accompanying figures.

It should be clearly understood that the embodiments of cone mount described herein are examples, and although described with reference to light reflectors, optical films and light fixtures, may also be adapted for use with other different cone types and configurations. For example, any cone, whether solid or hollow, which may require a support or mounting structure, wherein the combined flexibility of the cone and example embodiment of cone mount may allow attachment of the cone mount to the cone, may benefit from some or all of the advantages of example embodiments. Such cones may include cones configured from paper or plastics for non-optical applications, cones which may be injection molded, stamped, or thermoformed etc. Example embodiments of cone mount may also be utilized as gaskets for cone shaped objects, for example, mechanical parts, metal valves etc.

Figure 2A:
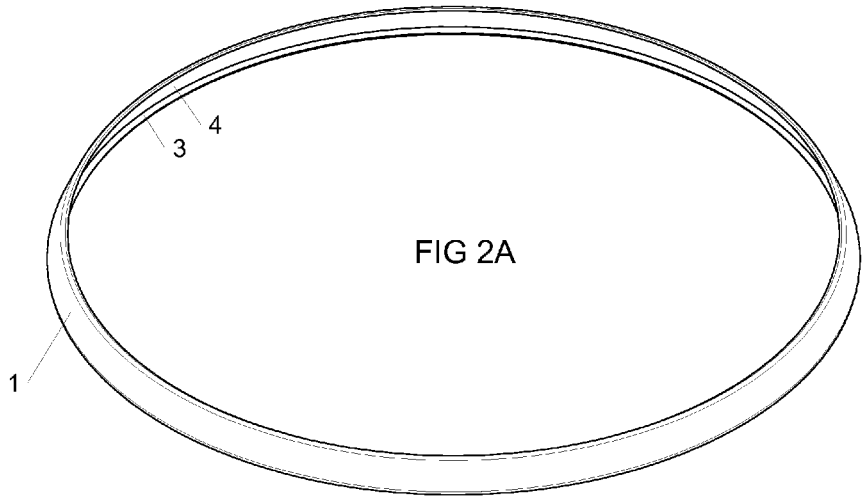
FIG. 2A shows a perspective view of an example embodiment of cone mounting, support or gasket apparatus.
Figure 2B:
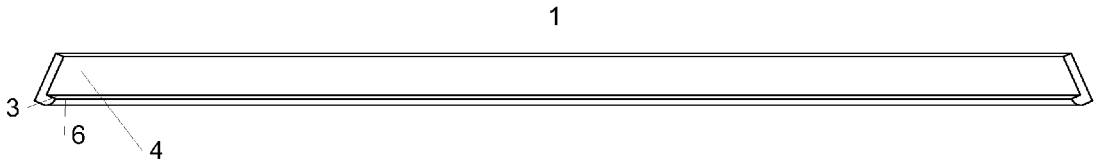
FIG. 2B shows a cutaway side view of an example embodiment of cone mounting, support or gasket apparatus.
Figure 2C:
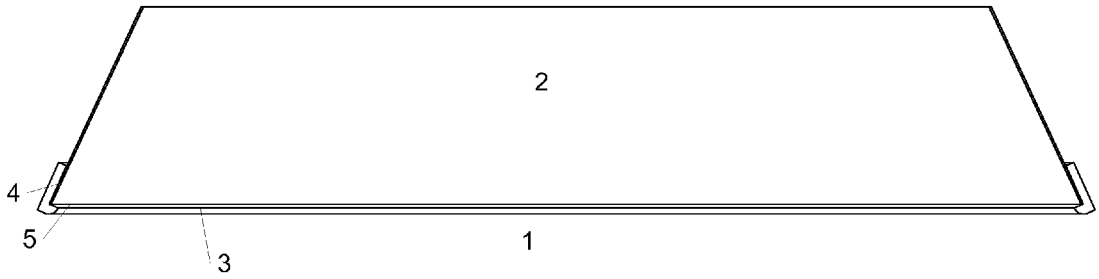
FIG. 2C shows a cutaway side view of an example embodiment of cone mounting, support or gasket apparatus with a cone mounted therein.

FIG. 2A shows a top perspective view of an example embodiment of cone mount 1, which includes ledge 3, and conical wall 4. FIG. 2B shows a side cutaway view of the same cone mount 1, with ledge 3, conical wall 4, and ledge lip 6 also indicated. FIG. 2C shows a partial side cutaway view of a hollow cone 2 mounted in the cone mount 1. The directrix (the perimeter of the base of a cone) 5 of cone 2 sits on ledge 3, and the cone outer surface near the cone directrix 2 is disposed directly adjacent to, or touching conical wall 4.

FIG. 1B shows a hollow cone 2 disposed inside and below cone mount 1. The hollow cone 2 may be moved in the direction of the arrow until the cone directrix 5 deforms and moves past lip 6 and is seated on ledge 3. When cone 2 is seated in cone mount 1 (as shown in FIG. 1A) the outer cone surface near the cone directrix 5 may be directly adjacent to, or touching conical wall 4.

Figure 4:
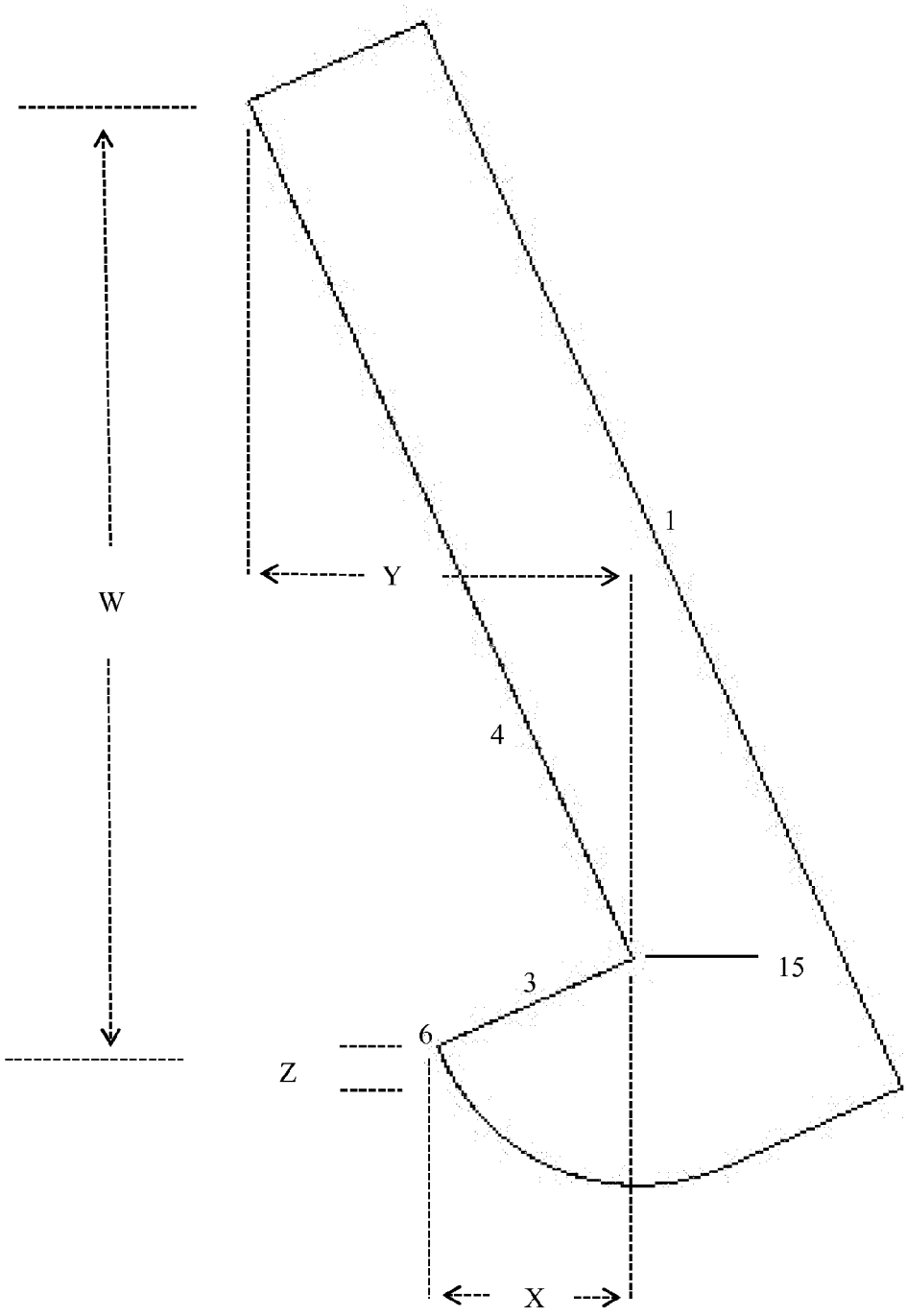
FIG. 4 shows a diagram of a side profile view of a small cross section of an example embodiment of cone mount.

Referring to FIG. 4, when a cone with a bottom opening diameter approximately equal to the diameter of the circle 15 created by the vertex of ledge 3 and conical wall 4, is inserted and seated in cone mount 1 as described, the cone wall near cone the directrix must deform by some portion of distance X. If the cone directrix (FIG. 1B feature 5) is inserted into and parallel to cone mount 1, then the cone wall may be required to deform by substantially all of distance X in order to seat on ledge 3. The cone may alternatively be inserted at an angle, wherein various portions of the cone directrix may be sequentially seated onto ledge 3, wherein the distance the cone wall may be required to deform may be a lesser portion of distance X.

Using an example of a reflector cone made from two layers of optical film, the thickness of the cone wall may be approximately 300 um to 400 um. Accordingly, distance X may be relatively shallow, for example, 600 um, wherein the cone wall near the directrix may need only deform a portion of this relatively small distance, and only along a relatively short vertical interference distance as indicated by distance Z. By virtue of this, it may be relatively easy to insert and seat a cone as described, into an example embodiment of cone mount.

When a cone as described is seated in cone mount 1 as described, cone directrix 5 may be seated on ledge 3. By virtue of such, the cone may be relatively secure from any downward movement.

When a cone as described is seated in cone mount 1 as described, the cone may also be held substantially secure against any upward movement of the cone, i.e. a high pullout force. If the cone were to be pulled vertically out of the cone mount 1, the cone wall may be required to deform by all, or a portion of horizontal distance Y, which may be substantially greater than horizontal distance X. In addition, the cone may be required to deform over a vertical interference distance as designated by distance W, which is substantially greater than vertical distance Z. As such, a relatively high pullout force may be required to pull the cone vertically out of the cone mount 1. Distance W may be increased or decreased as desired, by increasing or decreasing the length of conical wall 4, which may intern increase or decrease the required pullout force.

By virtue of the factors described, a cone may be easily inserted and seated into an example embodiment of cone mount, and once seated, may be held secure within the cone mount. Accordingly, an example embodiment may have the advantage of securely mounting or supporting a cone without the use of fasteners or adhesives. This may save on labor cost and assembly time.

According to an example embodiment, the cone mount as described and shown in FIGS. 1A, 1B, 2A, 2B, and 2C may also have the advantage of low manufacturing cost. Being an extraordinarily simple design as shown, example embodiments may lend themselves to many or all of the most inexpensive methods of mass manufacturing. An example embodiment may be fabricated from any suitable plastic or metal, and may be stamped, thermoformed, injection molded etc. With no fasteners or adhesives, and a simple "snap in" assembly, assembly cost and labor may be advantageously low.

When sufficient vertical pullout force is applied to a seated cone in an example embodiment, the cone may deform enough wherein it will release from the cone mount. Typical optical films may not be damaged by this degree of deformation of the cone wall. Accordingly, an example embodiment may have the advantage of securely mounting or supporting a cone without the use of fasteners or adhesives, and which may allow the cone to be removable from an example embodiment.

In an example embodiment, a cone utilizing optical films was used as an example for illustrative purposes. The optical film cone has a degree of flexibility that may allow the cone wall to deform sufficiently to be attached and seated in an example embodiment of cone mount. However, a cone does not necessarily have to be partially flexible in order to be attached and seated in example embodiments. A cone comprising a rigid material may also be utilized. An example embodiment of cone mount may be configured from a partially flexible material, such as certain softer plastics, which may offer a sufficient range of deformation of the conical wall and ledge, whereby a rigid cone may be attached and seated. Accordingly, example embodiments of cone mounts with varying degrees of flexibility may be combined with cones of varying degrees of flexibility, provided the combined range of flexibility is adequate for the cone to attach and seat in the cone mount.

An example embodiment of cone mount will now be described, which may functioning as a cone mount similar to a previously described example embodiment, but also may have the advantage of functioning as trim ring, and being able to retrofit over top of an existing installed commercial downlight reflector.

Typically in general lighting applications, recessed downlights may be spaced relatively close together, which may result in numerous downlights being installed in a given space. Due to this potentially large quantity of downlights in a given space, time and labor costs may become significant in a situation where new downlight reflectors are to be retrofitted into existing fixture enclosures, and the existing reflectors need to be removed. Downlight reflectors may be difficult to remove, especially ones that are old. The springs or torsion clips may be difficult or time consuming to release from the enclosure, and the trim rings may be stuck to the ceiling from previous layers of paint. The removal of a stuck trim ring may cause ceiling paint to chip or crack, or the drywall may become damaged. Also, trim ring sizes vary, and in a situation where a new reflector is installed where the trim ring is smaller than the old trim ring, the gap between the new trim ring coverage and the old trim ring coverage, may be clearly visible. There may be no paint on the ceiling in this gap, discolored or faded paint, or a different color or shade from a previous paint job. In any of these cases, ceiling repair and paint may be necessary, which may incur a significant cost and inconvenience. A retrofit downlight reflector that can be installed, and which does not require the existing reflector to be removed, may thus be very advantageous.

Figure 5A:
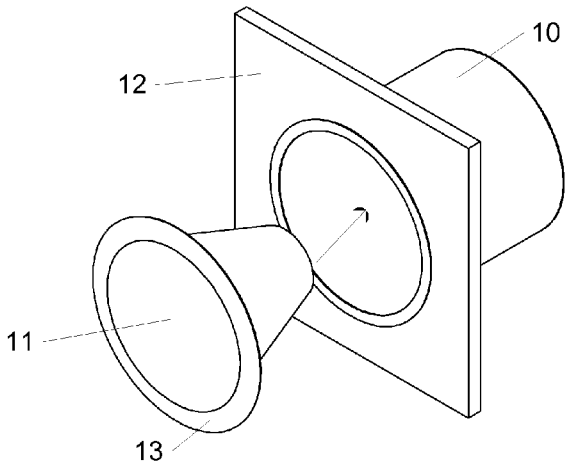
FIG. 5A shows an exploded perspective view of a typical full cone commercial downlight reflector and light fixture enclosure.
Figure 5B:
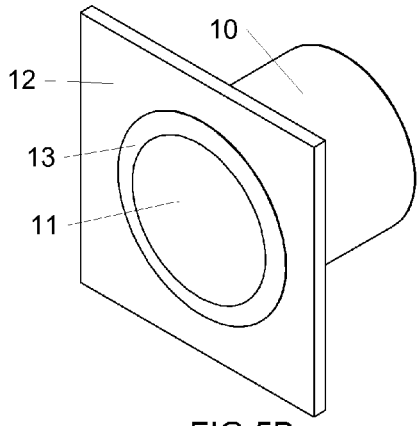
FIG. 5B shows a perspective view of the typical full cone commercial downlight reflector and light fixture enclosure shown in FIG. 5A.

FIG. 5A shows a simplified exploded perspective view of a typical commercial one piece downlight reflector cone 11, which may attach to recessed light fixture enclosure 10 which is mounted into a ceiling 12. The reflector cone 11 may be inserted into the fixture enclosure 10 in the direction of the arrow, and may typically be fastened to the fixture enclosure 10 with torsion clips. Such typical downlight reflectors may have a trim ring 13, which may serve as a cosmetic trim piece that lays flat on a ceiling surface when installed. Other typical commercial downlight reflectors, such as those designed for reflector type lamps for example, may comprise two pieces, wherein the trim ring is a separate piece that attaches to the reflector cone. FIG. 5B shows a perspective view of the installed commercial reflector cone 11 attached to light fixture enclosure 10, mounted in ceiling 12. Trim ring 13 is disposed on the ceiling surface 12.

Figure 5C:
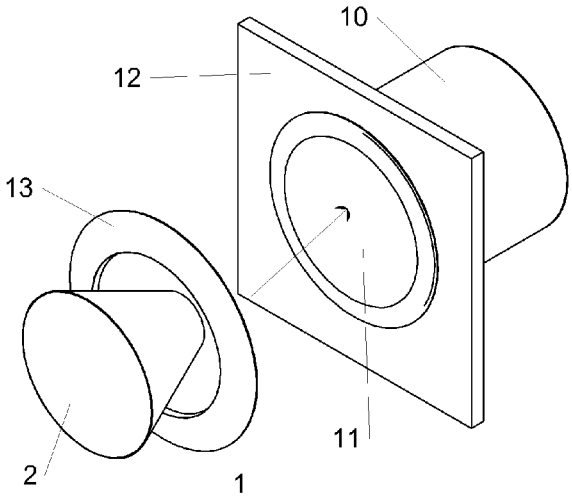
FIG. 5C shows an exploded perspective view of an example embodiment of cone mount with reflector cone, configured to retrofit over top of the downlight reflector shown in FIG. 5B.
Figure 5D:
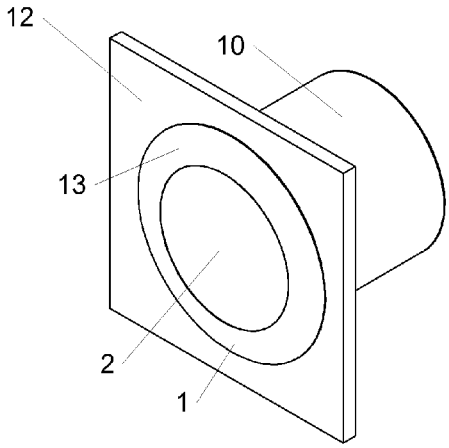
FIG. 5D shows a perspective view of the example embodiment of cone mount with reflector cone shown in FIG. 5C, configured to retrofit over top of the downlight reflector shown in FIG. 5B.

FIG. 5C shows an exploded perspective view of an example embodiment of cone mount 1 and reflector cone 2, wherein that assembly may be inserted in the direction of the arrow, over top of, and attached to, the existing commercial reflector 11, which is mounted on light fixture enclosure 10, and mounted on ceiling 12. FIG. 5D shows a perspective view of the installed example embodiment.

An example embodiment of cone mount may be sized such that it may fully cover any anticipated existing reflector/trim ring assembly when installed, and lie flat on a ceiling with minimal gaps. The example embodiment of cone mount may be attached to the existing reflector's trim ring with adhesive putty. Two or more strips of adhesive putty (preferably four) may be placed on the backside of the cone mount, and the cone mount may be appropriately situated over top of an existing reflector's trim ring, and subsequently pressed into place. Adhesive putty has the advantage of being able to be configured with a thickness that may adapt to the size of the gap between the cone mount and all anticipated existing reflectors. It has been found that typical adhesive putty such as putty commonly used to attach posters to walls, has sufficient bonding force to secure the weight of example embodiments of cone mount with reflector cone installed.

An example embodiment of cone mount will now be described wherein the cone mount also functions as a trim ring, and may attach to a light fixture enclosure. FIG. 6A shows an exploded perspective view of an example embodiment. Cone reflector 2 which may be similar to those described in other example embodiments, may insert into cone mount 1 as described in previous example embodiments, and the cone mount/reflector cone assembly may be inserted into light fixture enclosure 10 in the direction of the arrow. The described assembly may attach to the light fixture enclosure with springs, elastic cord or torsion clips (not shown). The springs or torsion clips may attach to the cone mount at suitable mounting points that may be configured in the cone mount. If the cone mount 1 is comprised of plastic, and the reflector cone is comprised of optical film as described in other example embodiments, the combined assembly may be very lightweight. Accordingly, the springs or torsion clips may be much smaller and lighter gauge than typical springs or clips used with typical commercial reflectors. FIG. 6B shows a perspective view of the cone mount 1 and installed reflector cone 2 mounted on light fixture enclosure 10.

Figure 3A:
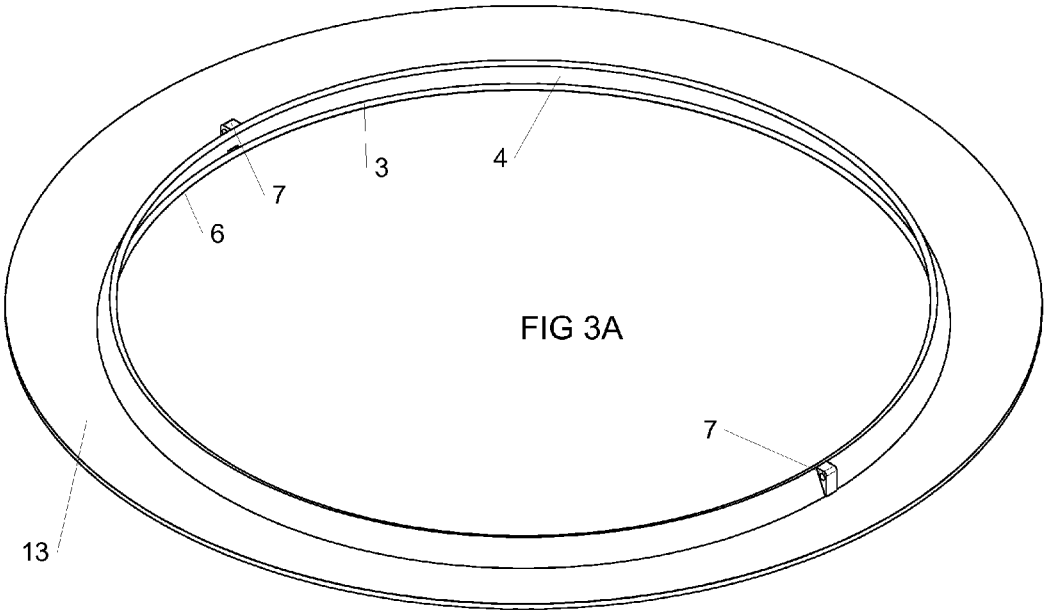
FIG. 3A shows a perspective view of the backside of an example embodiment of cone mount configured to attach to a recessed light fixture enclosure.
Figure 3B:
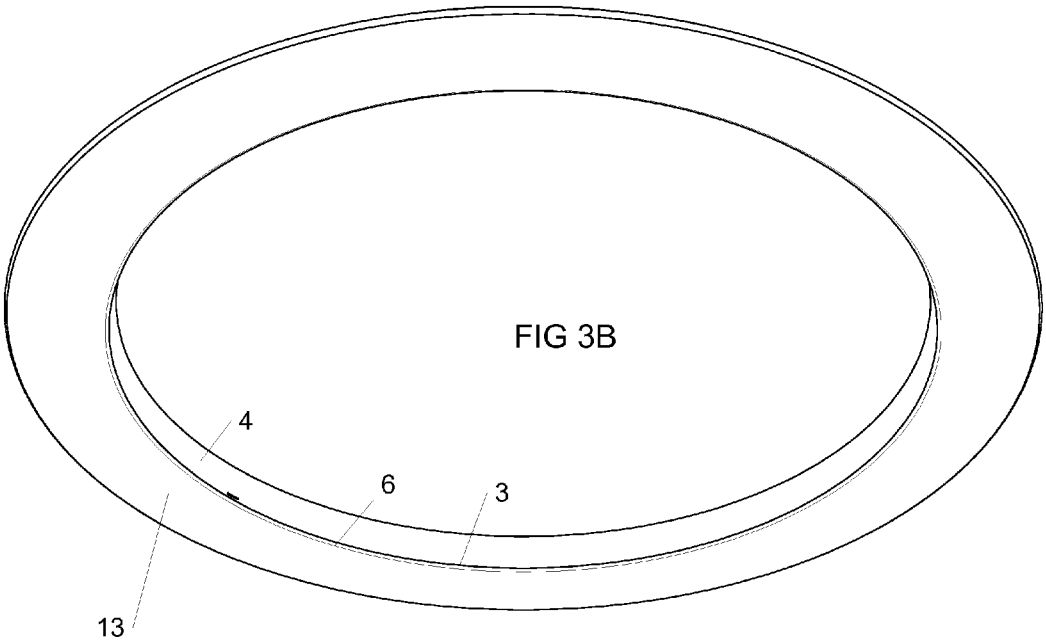
FIG. 3B shows a perspective view of the front side of an example embodiment of cone mount configured to attach to a recessed light fixture enclosure.

The example embodiment described in FIGS. 6A and 6B is very similar to the example embodiment described in FIGS. 5C and 5D. However, the example embodiment of cone mount described in FIGS. 6A and 6B may be sized similarly to that of typical commercially available reflector trim rings, since it doesn't have to retrofit over top of existing downlight reflector trim rings. The example embodiment of cone mount described in FIGS. 6A and 6B may require features to enable its attachment to light fixture enclosures with springs or torsion clips. FIGS. 3A and 3B shows a top and bottom perspective view of an example embodiment. Similar to other example embodiments, conical wall 4, ledge 3, lip 6 and trim ring 13 are indicated. Also shown is an example of a mounting tab 7, wherein light gauge springs or torsion clips may fasten through the hole on mounting tab 7, wherein the springs or torsion clips may attach to a light fixture enclosure.

As shown in FIGS. 5A and 5B, typical downlight reflectors have trim rings 13 that serve as a cosmetic trim piece, and to function to hold the reflector in place. As shown in FIGS. 5C, 5D, 6A and 6B, cone mount 1 has integral trim ring 13. The cone mount 1 may therefore function both as a cone support and mounting device, as well as a cosmetic trim ring.

In an example embodiment of cone mount, the cone mount may function as a gasket. It may be fabricated from any material suitable to a given application, for example, gasket material suitable for use with hydraulic fluid, water, air, oil etc. This may have the advantage that a cone may be fitted with a gasket without requiring any penetrations into the cone surface or cone gasket. This may offer a better seal, and not require any fasteners, such as rivets or screws or bolts for example, which may interfere with the functioning of the gasket, especially when the gasket becomes worn or damaged. Additionally, removal and replacement of the gasket may require less time and cost. For example, cone shaped metal valves used in pneumatic or hydraulic systems may be fitted with an example embodiment of gasket.

Various example embodiments of cone mounting, support or gasket apparatuses have been thus far presented and described. According to an example embodiment of the disclosed technology, a cone mounting, support or gasket apparatus is provided that is configured to attach to a cone, wherein the cone comprises a directrix and an outer surface. The cone mounting, support or gasket apparatus comprises a ring shaped structure defined by an inner surface comprising a conical wall, wherein the conical wall has a bottom and a top. The bottom of the conical wall has a greater diameter than the top of the conical wall, and the angle of the conical wall is similar to the angle of the cone outer surface. The ring shaped structure includes a ledge, wherein the ledge originates at the bottom of the conical wall and protrudes away from the conical wall. The cone attaches to the cone support apparatus whereby the directrix of the cone is disposed on the ledge of the ring shaped structure.

In an example embodiment, the cone mounting, support or gasket apparatus is configured to provide structural support to a cone. In another example embodiment, the cone mounting, support or gasket apparatus is comprised of a substantially rigid material. In an example embodiment, it is comprised of a partially flexible material.

In an example implementation, the cone is comprised of a substantially rigid material and the cone mounting, support or gasket apparatus is comprised of a partially flexible material.

In a similar example implementation, the cone is comprised of a partially flexible material and the cone mounting, support or gasket apparatus is comprised of a substantially rigid material.

In an example embodiment, the cone mounting, support or gasket apparatus attaches to a cone without any fasteners, adhesive or additional parts.

In an example embodiment, the cone mounting, support or gasket apparatus is configured to attach to a cone configured from one or more optical films, wherein the cone is configured to reflect light from a light source disposed in proximity to the inside of the cone.

In an example embodiment, the cone mounting, support or gasket apparatus is configured to function as a gasket for a cone directrix. In another example implementation, the cone mounting, support or gasket apparatus is configured to function as a gasket, wherein the cone is a cone shaped valve.

Another example embodiment of the disclosed technology is directed to an apparatuses for providing a cone support and mounting apparatus configured to attach to a cone, wherein the cone comprises a directrix and an outer surface. The cone support and mounting apparatus comprises a ring shaped structure defined by an inner surface comprising a conical wall, wherein the conical wall has a bottom and a top. The bottom of the conical wall has a greater diameter than the top of the conical wall, and the angle of the conical wall is similar to the angle of the outer cone surface of the cone. The ring shaped structure includes a ledge, wherein the ledge originates at the bottom of the conical wall and protrudes towards away from the conical wall. The cone attaches to the cone support and mounting apparatus whereby the directrix of the cone is disposed on the ledge of the ring shaped structure, and the ring shaped structure is configured to attach to an external surface.

In an example embodiment, the ring shaped structure of the cone support and mounting apparatus is configured to attach to a light fixture enclosure. In a similar example embodiment, the ring shaped structure of the cone support and mounting apparatus is configured to attach to a light fixture enclosure, wherein the ring shaped structure is configured to be disposed on a ceiling surface.

In an example embodiment, the ring shaped structure of the cone support and mounting apparatus is configured to retrofit over top of an existing light reflector. In a similar example embodiment, the ring shaped structure of the cone support and mounting apparatus is configured to retrofit over top of an existing light reflector's trim ring. In a similar example embodiment, the ring shaped structure of the cone support and mounting apparatus is configured to attach to a ceiling surface.

I claim:

1. A cone mounting, support or gasket apparatus configured to attach to a cone, wherein the cone comprises a directrix and an outer surface, wherein the cone mounting, support or gasket apparatus comprises:

a ring shaped structure defined by:

an inner surface comprising a conical wall, wherein the conical wall has a bottom and a top, wherein the bottom of the conical wall has a greater diameter than the top of the conical wall, and wherein the angle of the conical wall is similar to the angle of the cone outer surface; and a ledge, wherein the ledge originates at the bottom of the conical wall and protrudes away from the conical wall; and the cone attaches to the cone mounting, support or gasket apparatus whereby the directrix of the cone is disposed on the ledge of the ring shaped structure.

2. The cone mounting, support or gasket apparatus of claim 1 is configured to provide structural support to the cone.

3. The cone mounting, support or gasket apparatus of claim 1 is comprised of a substantially rigid material.

4. The cone mounting, support or gasket apparatus of claim 1 is comprised of a partially flexible material.

5. The cone, and the cone mounting, support or gasket apparatus of claim 1, wherein the cone is comprised of a substantially rigid material and the mounting, support or gasket apparatus is comprised of a partially flexible material.

6. The cone, and cone mounting, support or gasket apparatus of claim 1, wherein the cone is comprised of a partially flexible material and the cone mounting, support or gasket apparatus is comprised of a substantially rigid material.

7. The cone, and cone mounting, support or gasket apparatus and cone of claim 1, wherein the cone mounting, support or gasket apparatus attaches to the cone without any fasteners, adhesive or additional parts.

8. The cone of claim 1 is hollow and configured from one or more optical films, and configured to reflect light from a light source disposed in proximity to the inside of the cone.

9. The cone mounting, support or gasket apparatus of claim 1 is configured to function as a gasket.

10. The cone mounting, support or gasket apparatus and cone of claim 1, wherein the cone mounting, support or gasket apparatus is configured to function as a gasket, and the cone is a valve.

11. A cone support and mounting apparatus configured to attach to a cone, wherein the cone comprises a directrix and an outer surface, and wherein the cone support and mounting apparatus comprises:

a ring shaped structure defined by:

an inner surface comprising a conical wall, wherein the conical wall has a bottom and a top, wherein the bottom of the conical wall has a greater diameter than the top of the conical wall, and wherein the angle of the conical wall is similar to the angle of the cone outer surface; and a ledge, wherein the ledge originates at the bottom of the conical wall and protrudes towards away from the conical wall;

wherein the cone attaches to the cone support and mounting apparatus whereby the directrix of the cone is disposed on the ledge of the ring shaped structure; and the ring shaped structure is configured to attach to an external surface.

12. The ring shaped structure of the cone support and mounting apparatus of claim 11 is configured to attach to a light fixture enclosure.

13. The ring shaped structure of the cone support and mounting apparatus of claim 11 is configured to attach to a light fixture enclosure, wherein the ring shaped structure is configured to be disposed on a ceiling surface.

14. The ring shaped structure of the cone support and mounting apparatus of claim 11 is configured to retrofit over top of an existing light reflector.

15. The ring shaped structure of the cone support and mounting apparatus of claim 11 is configured to retrofit over top of an existing light reflector's trim ring.

16. The ring shaped structure of the cone support and mounting apparatus of claim 11 is configured to attach to a ceiling surface.

17. The cone, and cone support and mounting apparatus and cone of claim 11, wherein the cone support and mounting apparatus attaches to the cone without any fasteners, adhesive or additional parts.

18. The cone of claim 11 is hollow and comprised of one or more optical films, and is configured to reflect light from a light source disposed in proximity to the inside of the cone.

* * * * *